US005657784A

United States Patent [19]

Martens

[11] Patent Number: 5,657,784

[45] Date of Patent: Aug. 19, 1997

[54] CONTROL ARRANGEMENT FOR ACTUATING A SHUT-OFF VALVE AND METHOD OF OPERATION

[75] Inventor: Peter Martens, Hamburg, Germany

[73] Assignee: Roediger Anlagenbau GmbH, Hanau, Germany

[21] Appl. No.: 326,214

[22] Filed: Oct. 20, 1994

[30] Foreign Application Priority Data

Oct. 22, 1993 [DE] Germany ..... 43 36 020.3

[51] Int. Cl.[6] ..... F16K 17/00

[52] U.S. Cl. ..... 137/12; 137/396; 137/489.5; 137/907; 251/75

[58] Field of Search ..... 137/12, 396, 489.5, 137/907; 251/75

[56] References Cited

U.S. PATENT DOCUMENTS

| | | | |
|---|---|---|---|
| 2,620,825 | 12/1952 | Cannon | 251/75 X |
| 3,174,500 | 3/1965 | Johnson et al. | 251/75 X |
| 3,998,736 | 12/1976 | Greenleaf | 137/396 X |
| 5,048,558 | 9/1991 | Calhoun | 137/396 |
| 5,269,337 | 12/1993 | Goldsmith | 137/907 X |

FOREIGN PATENT DOCUMENTS

| | | |
|---|---|---|
| 3727661 | 3/1989 | Germany . |
| 3823515 | 11/1989 | Germany . |

OTHER PUBLICATIONS

Alan F. Hassett, John C. Starnes, Journal WPCF, vol. 53. No. 1 pp. 59–65, "Vacuum Wastewater Collection . . . ".

Gray, "Vacuum Sewers: Fundamentals and Design Methods" 1988 Critical Water Issues and Computer Applications: Proceedings of the 15th Annual Water Resources Conference (Abstract only).

Gray, "Toward a New Model for Head Loss in Vacuum Sewers" 1985 1985 International Symposium on Urban Hydrology, Hydraulic Infrastructures and Water Quality Control (Abstract only).

Foreman, "Wastewater Collection by Vacuum" 1985 1985 International Symposium on Urban Hydrology, Hydraulic Infrastructures and Water Quality Control (Abstract only).

*Primary Examiner*—Stephen M. Hepperle

*Attorney, Agent, or Firm*—Dennison, Meserole, Pollack & Scheiner

[57] ABSTRACT

A control arrangement (10) for a shut-off valve actuable by vacuum and intended for use in vacuum waste water systems, comprising a first valve (14) which is actuated by static pressure of collected waste water, and including a chamber (56) which can be put under vacuum via the first valve, whereby a second valve (20), charged by a spring (71), is abruptly opened when the pressure in the chamber drops below a preset level, so that vacuum reaches the shut-off valve and opens it, and, in case static pressure is reduced, the first valve closes and the chamber is gradually ventilated until the pressure in this chamber reaches a preset level at which the second valve and in turn the shut-off valve abruptly close.

17 Claims, 5 Drawing Sheets

CONTROL ARRANGEMENT FOR ACTUATING A SHUT-OFF VALVE AND METHOD OF OPERATION

BACKGROUND OF THE INVENTION

The invention relates to a control arrangement for actuating a shut-off valve and method of operation.

To keep bodies of water clean it is necessary for waste water to be passed into sewage plants. However, this is often not possible because of disproportionally high costs for conventional sewer systems or because of difficult local conditions, such as lacking natural gradients, low population density, disadvantageous subsoil or transition through an area of a protected water table. But even for such problem cases there is a possibility for providing disposal by means of a sewage plant, if an underpressure drainage system or a "vacuum drainage" is employed.

An appropriate vacuum drainage comprises as essential components connecting pits in houses with a currentless-operating control arrangement and shut-off or drain-off valves, a connecting line system with systematically disposed high and low points and a vacuum station with waste water storage tanks, waste water pumps, vacuum pumps, technical measuring and control devices.

For conveying the waste water, it first flows out of the buildings via conventional gravity-action building connecting lines to a shaft, for example located at the property boundary, in which the shut-off valves, which are controlled exclusively pneumatically, and the associated control arrangement are housed.

When a set static pressure has been reached, the shut-off valve is opened by the mechanism contained in the control arrangement and the waste water is drained off through the vacuum line. After a few seconds the valve is closed as a function of time by means of a spring force and vacuum.

The waste water itself collects at the low points in the line system and is pushed gradually over subsequent high points in the direction of the vacuum station by spurts of air. Then the water is transported via a pressure and gravity-action line from the collecting tank of the vacuum station to the sewage plant by conventional waste water pumps.

In this case the control device associated with the shut-off valve should allow an automatic adaptation to the amounts of waste water to be drained off and the operating conditions of the waste water system.

A control arrangement of the type described at the outset is known under the designation "AIRVAC". Time control takes place via a pressure-adjustable chamber which at the start is charged with atmospheric pressure. There is no clear OPEN/CLOSED position of the second valve directing the underpressure to the shut-off valve. This means that the amounts of the waste water or the waste water-air mixture per opening cycle of the shut-off valve are not clearly defined. This can lead to malfunctions, in particular in case of large amounts of waste water. It is furthermore disadvantageous that the drain-off time depends, in a manner which is unfavorable for the entire system, on the available underpressure, since the opening times themselves depend on the prevailing underpressure.

It is furthermore disadvantageous that opening of the second valve, which releases the underpressure to the shut-off valve, can already take place at low underpressure which, however, is not sufficient for drain-off. This leads to the danger that waste water is lifted into the area of the line exposed to freezing and can freeze out there.

A pneumatic control device for a shut-off valve of an underpressure waste water line is known from DE 37 27 661 A1. At least one control valve and a minimum underpressure valve, besides a first valve operated by a static pressure and a structurally elaborate time control device, are required to assure exact setting and dependable operation of the control device.

An elaborate construction and assembly is required because of the complex mechanical construction of the time control device in particular which, among other things, comprises a diaphragm piston with a hollow pin which is guided in a guide bushing for opening or closing the control valves.

DE 38 23 515 A1 describes an aspirating pistol by means of which it is possible to drain off waste water from a reservoir by means of underpressure. In addition to an drain-off valve which closes and opens an underpressure line through which the waste water is drained off, a control valve is required which can be manually or automatically operated. So that the control valve can be closed when the underpressure is reduced, because of which the shut-off valve is disconnected from the underpressure, the control valve has a valve piston on which, as a function of the position of the valve piston, axially and/or radially spring-loaded balls act which are required for closing the control valve.

OBJECTS OF THE INVENTION

The present invention has as an object to further develop a method and a control arrangement of the previously described type in such a way that, along with a compact and simple construction, a large degree of operational dependability is assured, wherein a time control is performed which essentially is independent of the underpressure, i.e. that after removal of the dynamic pressure the control arrangement cuts off the underpressure supply to the shut-off valve after a defined time interval. In the process it is simultaneously intended to assure that in case of an underpressure the valve which controls the underpressure to the shut-off valve always takes up a defined position which assures that waste water can be drained off via the shut-off valve.

In accordance with the invention, a clear OPEN/CLOSED position of the second valve controlling the underpressure to the shut-off valve is effected. Accordingly, the position of the shut-off valve is clearly defined.

The abruptly changing state (OPEN/CLOSED or CLOSED/OPEN) of the valve is achieved by so-called adjustable limiters, which, in the form of spring-loaded balls, act in the manner described below on the valve piston of the second valve. In this case the spring force can be set so as to permit the opening or closing of the second valve or the control valve only at previously set underpressure values. By means of this it is assured that lifting waste water from the reservoir can only take place if there is sufficient underpressure for draining-off. Accordingly, no waste water can stand in the freezing area of the line leading to the shut-off valve.

Alternatively the abruptly changing state can be realized by means of a magnet whose forces which act indirectly or directly on the second valve spontaneously change when preset pressure conditions arise.

The spring element acting on the valve piston of the second valve can be a spring disposed in pressure-adjustable chamber or in its vicinity, which exerts restoring forces on the valve piston.

It is alternatively also possible to generate restoring forces by means of a diaphragm disposed in the chamber and connected with the valve piston. However, the main object of such a diaphragm is to separate the chamber pressure-wise from a first area, which can be connected with the underpressure via the first valve, from a second area which is always only essentially charged with the atmospheric pressure. The diaphragm simultaneously has a guidance function for the valve piston.

In the preferred embodiment it is provided that the first and second valves are disposed in a cylindrical housing having connectors for the dynamic pressure and the underpressure as well as a connector to the shut-off valve, wherein the valve piston of the second valve is guidedly displaceable in a first housing section.

To make abrupt switching possible it is proposed to dispose elements as limiters in the first housing section receiving the valve piston in an axially displaceable manner, which act radially on the valve piston and engage it when the valve is closed or opened. However, it is provided in particular that the diaphragm connected with the valve piston of the second valve is kept in a first position by means of a magnet or, when the preset pressure change in the chamber or its vicinity has taken place, can be moved abruptly or to a large degree abruptly from the first position into a second position or vice versa, wherein in the first position the second valve blocks the underpressure connection to the shut-off valve and in the second position opens the underpressure connection to the shut-off valve.

To be able to perform pressure compensation in the shut-off valve it is furthermore proposed that the housing opening is connected with the first housing section receiving the valve piston of the second valve and that in the closed position of the second valve, which blocks the underpressure to the shut-off valve, it is connected pressure-wise with the shut-off valve via the housing section.

Further details, advantages and characteristics of the invention not only ensue from the claims, the characteristics to be taken therefrom—individually and/or in combination—, but also from the following description of a preferred exemplary embodiment to be found in the drawings.

Figure 1:
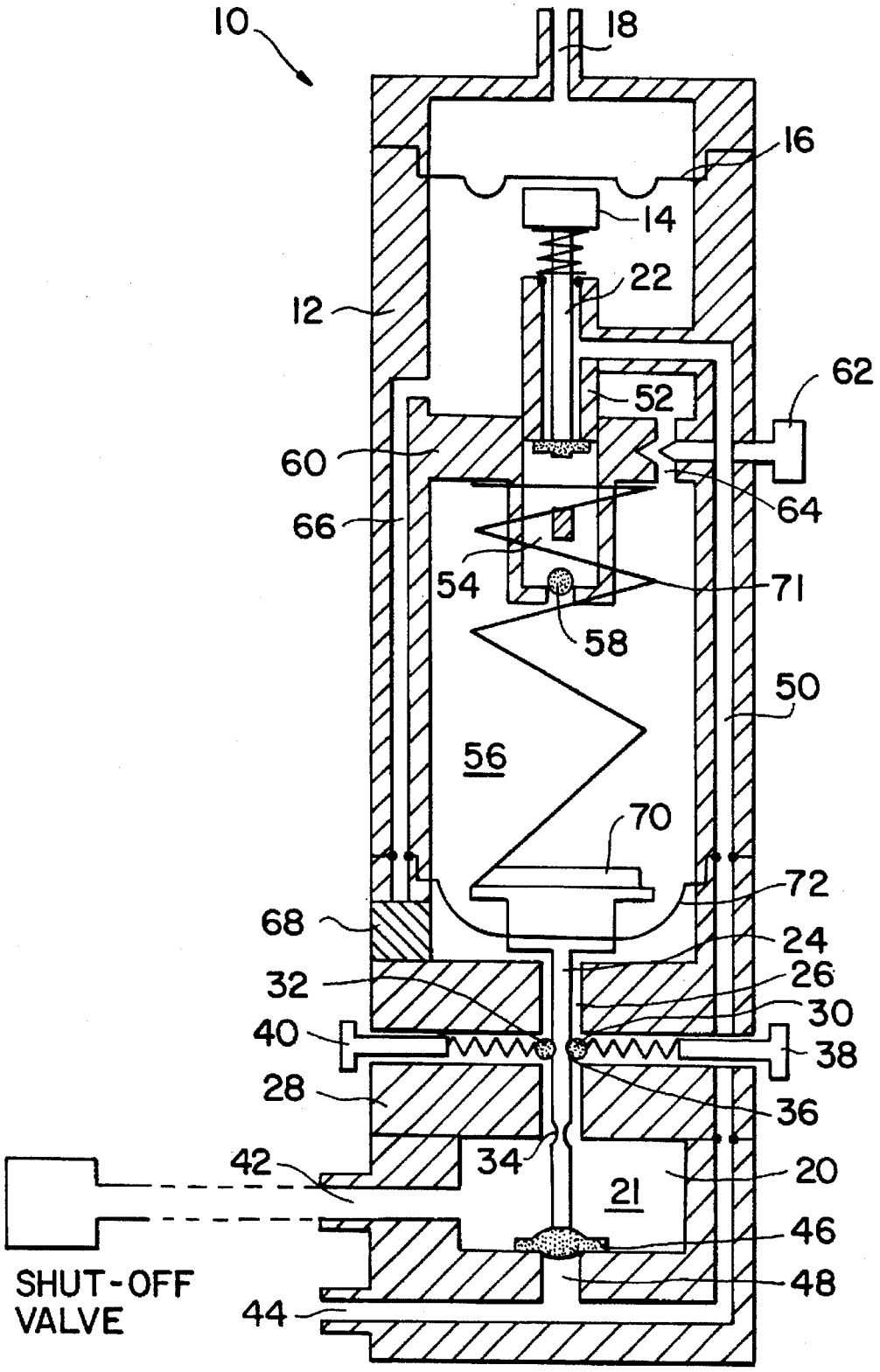
FIG. 1, a basic representation of a first embodiment of a compact control arrangement when static pressure is lacking, FIG. 2, the compact control arrangement of FIG. 1 when dynamic pressure is present, FIG. 3, the compact control arrangement in accordance with FIG. 1 and FIG. 2, wherein a connection with a shut-off valve of an underpressure waste water system can be made via a valve, FIG. 4, the compact control arrangement of FIG. 3, but with the static pressure removed, and FIG. 5, a second embodiment of a compact control arrangement.

The purely basic construction and function of the compact control arrangement (10) for a shut-off valve which can be actuated by underpressure and is intended for an underpressure waste water system shown in FIGS. 1 to 4 or 5.

The compact control arrangement (10), which operates currentless, but pneumatically, consists of a cylindrical housing (12), in which is disposed a first valve (14) or trigger valve having a head portion, which can be charged via a diaphragm (16) with a dynamic pressure reaching an opening (18) of the housing (12), and a second valve or control valve (20). The valve pistons (22) and (24) of the valves (14) and (20) are arranged along the longitudinal axis of the housing (12).

Figure 3:
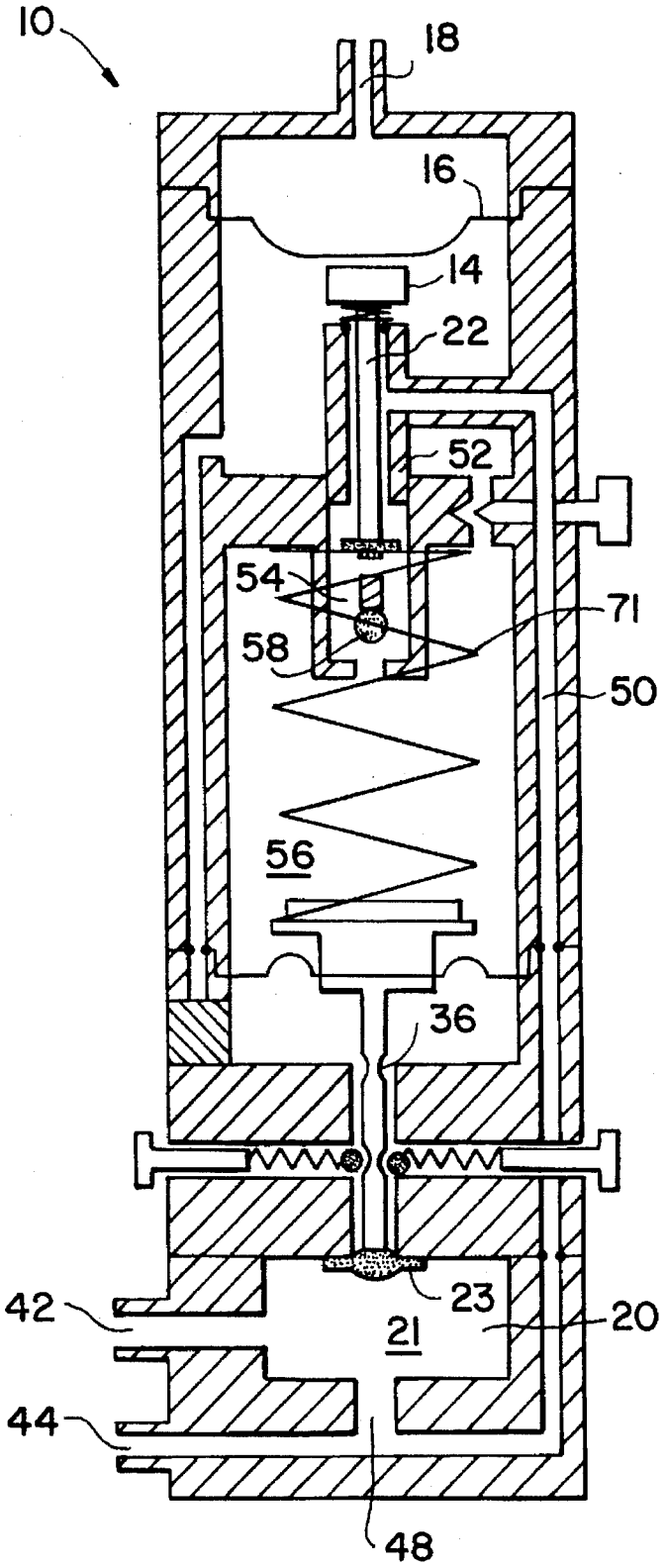
Figure 4:
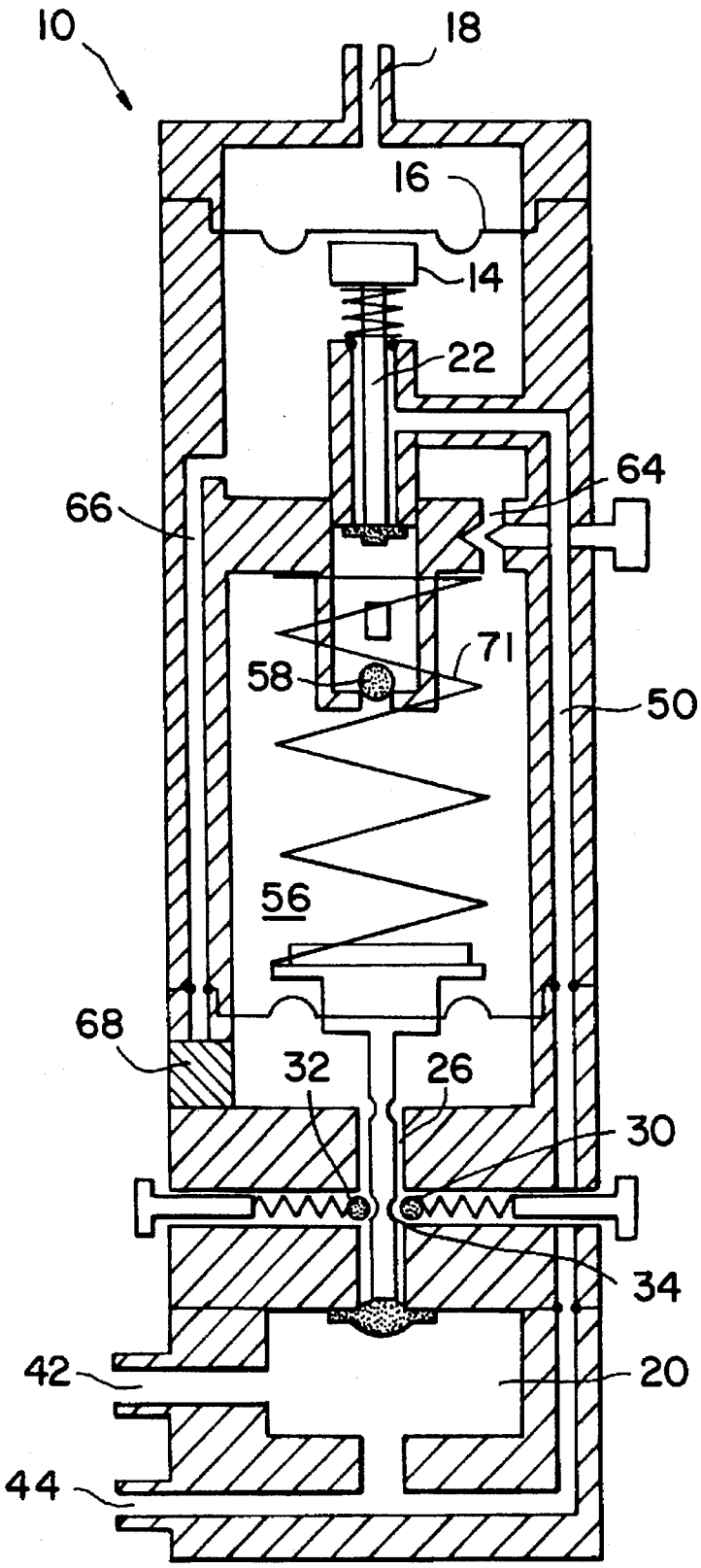

The valve piston (24) of the control valve (20) is guidedly received in a bore (20) of an intermediate bottom (28) of the housing (12). In the process, preferably three spring-loaded balls offset from each other by 120°, radially act on the outside of the valve piston (24), of which for reasons of simplicity two balls (30), (32) have been drawn in purely in principle, which can also be called snap balls, and which engage radially circumferential annular grooves (34) and (36) in the end positions of the valve (20), i.e. with the valve (20) closed (FIGS. 1 and 2) or the valve (20) open (FIGS. 3 and 4). In the process the spring force acting on the balls (30) and (32) can be changed by means of adjusting elements (38) and (40).

The ball snappers (30) and (32) perform the function of limiters here such, that in a manner to be described below the valve (20) abruptly switches from its closed into its opened position and vice versa.

Furthermore, a spring element such as a helical spring (71) acts on the valve piston (24) in the direction toward the closed position of the valve (20).

The valve disk (46) of the valve piston (24) is displaceably disposed in a valve chamber (21). A connector (42) starts from the valve chamber (21) and is connected with a shut-off valve, controllable via the compact control arrangement (10), of the underpressure waste water system in order to charge it with underpressure for allowing opening.

The underpressure required for this then flows via a connector (44) into the valve chamber (21) when the valve (20) is opened, i.e. its valve disk (46) frees an opening (48) connected with the connector (44).

Furthermore, a conduit (50) extending in the housing shell leads from the connector (44) and terminates in a tube-shaped inner housing section (52) which receives one of the valve pistons (22) of the first valve (14) or outlet valve, in order to be connected, when the valve (14) is open, via its valve chamber (54) with an inner chamber (56).

With the valve (14) closed, the valve chamber (54) is closed by means of a check valve (58) against the valve chamber (54).

The tube-shaped housing section (52), which is coaxially surrounded by a section of the spring (71), starts off from a further intermediate housing bottom (60), in which an opening (64) extends, the cross section of which can be changed via an adjusting element (62), through which a connection between the chamber (56) and a control line (66) takes place, which starts off from a housing opening (68) to provide a pressure compensation in the chamber (56) in the manner hereinafter described.

Not only does the opening (68), which can be closed by a filter, provide a connection to the control conduit (66), but also, via the bore (26) in the housing bottom (28), it provides a connection with the valve chamber (21) in order to provide a pressure compensation with the shut-off valve so that it can close.

To seal the chamber (56) against a direct connection with the housing opening (68), a diaphragm (72), which is sealed against the inner wall of the housing (12), extends from a cylindrical widening (70) of the valve piston (24) extending in the chamber (56).

Figure 2:
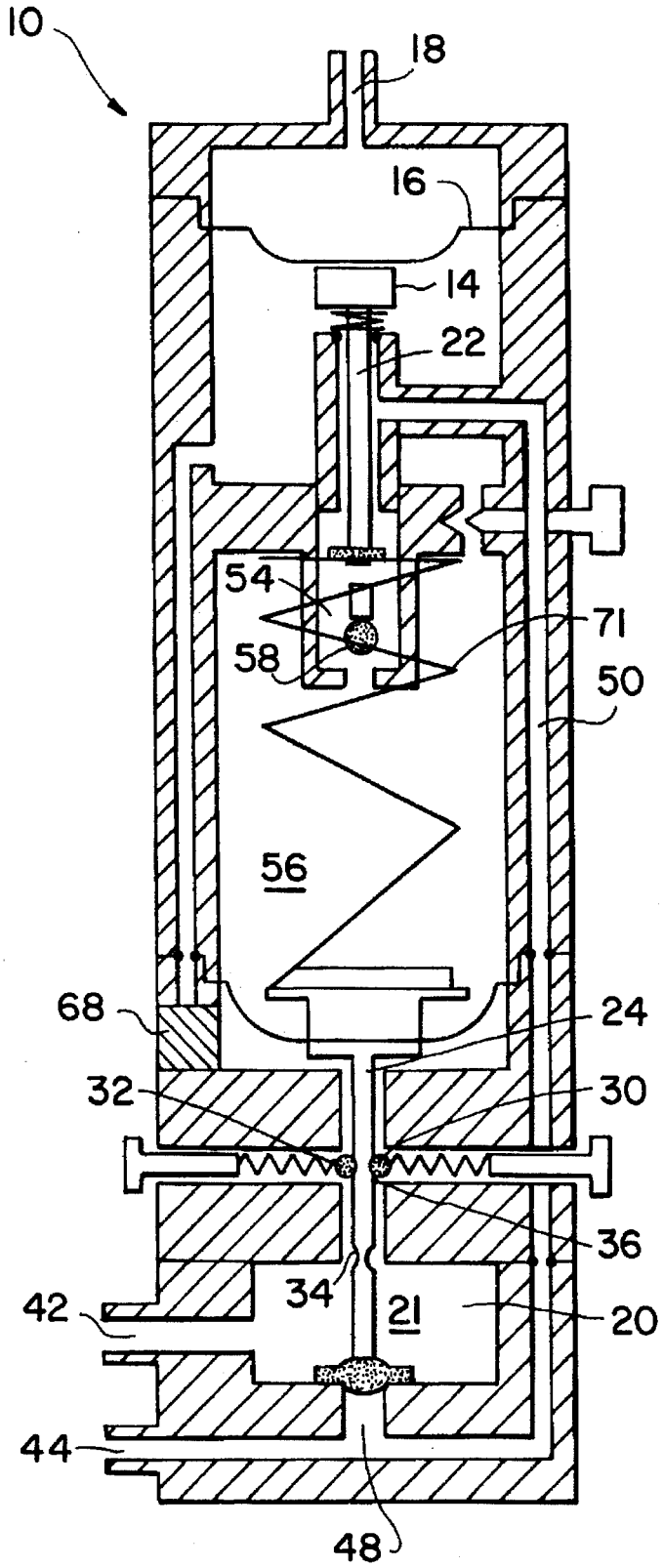

If, when reaching a defined amount of waste water in a standpipe, a dynamic pressure is transmitted via the opening (18) to the diaphragm (16), the valve (14) opens, so that the underpressure at the connector (44) can reach the valve chamber (54) via the conduit (50), bypassing the valve piston (22), and opens the check valve, so that an underpressure is generated in the chamber (56) (FIG. 2).

When the underpressure in the chamber (56) attains a value which is sufficient to overcome, on the one hand, the force of the spring (71) supported on the intermediate bottom (60) and, on the other hand, that of the snap balls (30), (32) acting on the valve piston (24), the control valve (20) abruptly opens and provides a connection via the opening (48) to the connector (42) to the shut-off valve, so that the underpressure required for opening the shut-off valve reaches it. As a result of this the waste water collected in the reservoir can be drained off (FIG. 3).

As soon as the required amount of waste water has been drained off, the static pressure acting on the diaphragm (16) collapses to such an extent that the trigger valve (14) and thus also the check valve (58) are closed and therefore underpressure can no longer reach the chamber (56) via the conduit (50) (FIG. 4). Simultaneously a pressure compensation takes place in the chamber (56) via the housing opening (68) and the control conduit (66) as well as the opening (64) whose cross section can be changed. Depending on the rapidity of the pressure compensation, which is predetermined by the cross section of the opening (64), the underpressure causing the contraction of the spring (71) is reduced so that, with continued pressure compensation in the chamber (56), the spring force can overcome the predeterminable forces of the snap balls (30), (32). Therefore the control valve (20) can abruptly switch back into the closed position (base position in FIG. 1). At this moment the underpressure via the connector (42) to the shut-off valve is disrupted. A pressure compensation then continues via the opening (68), the bore (26) surrounding the valve piston (24), the valve chamber (21) and the connector (42) in the direction of the shut-off valve, so that it can close again.

Based on the defined positions of the control valve (20) and the abrupt switching from its opened into its closed position and vice versa, no overlaps in respect to the presence of underpressure can occur.

A compact structure is assured because of the disposition of the valves (14) and (20) inside the cylindrical housing (12) and the course of the control conduits (50), (66) inside the housing wall, as well as the guidance of the valve pistons (22) and (24) in the intermediate bottoms (28) and (60) or the tube-shaped inner bottom sections (52) extending therefrom.

A mechanical timer switch of high operational capability is made available by means of the adjustable speed of the reduction of the underpressure in the chamber (56) together with the spring (71) of the ball snappers (30), (32), wherein defined opening times of the shut-off valve without overlaps are provided.

Furthermore, the limiter, realized by the snap balls, is an essential characteristic and assures that on the one hand an abrupt change in the state of the second valve occurs and, on the other hand, opening of the valve and thus charging with underpressure of the shut-off valve can only take place when the underpressure in the waste water systems is sufficient for actually conveying waste water through the shut-off valve.

Figure 5:
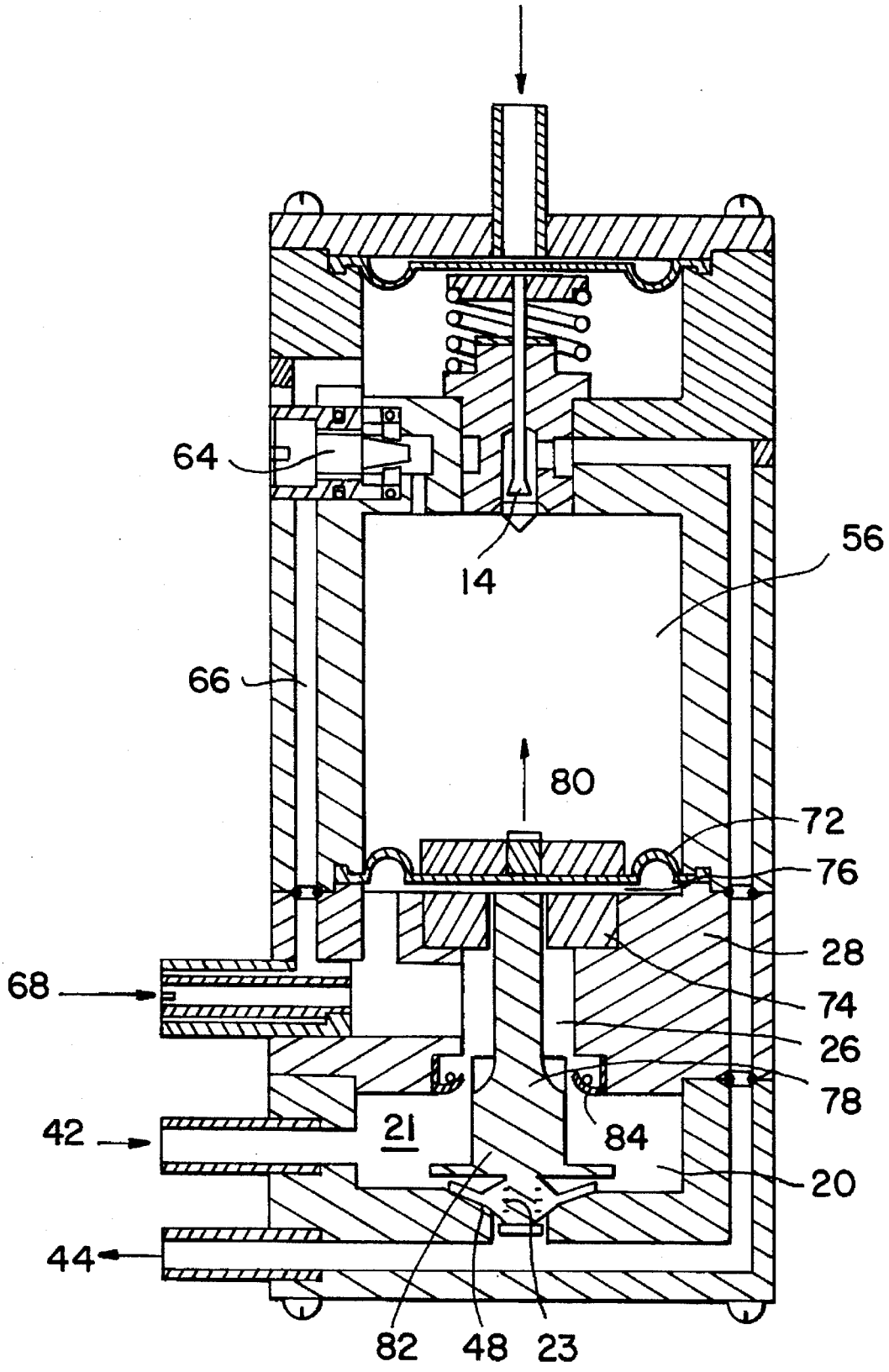

An alternative embodiment of a control arrangement which corresponds in structure and function to FIGS. 1 to 4 is shown purely in principle in FIG. 5. Basically like elements are provided with like reference numerals.

No limiters realized by means of snap balls are provided to also allow an abrupt switching of the second valve (20) from its opened into its closed position, i.e. to block the first existing connection between the underpressure connector (44) and the connector (42) to a shut-off valve, not shown, (representation of FIG. 5). Instead, a spontaneous switching of the second valve (20) is provided by means of a magnet (74) and a plate (76) assigned to it.

In the exemplary embodiment of FIG. 5, a magnet (74) is fixed in place coaxially with the valve piston (78) of the second valve (20) in the housing section (28) of the control arrangement. A metal plate (76) is provided opposite the magnet (74) and is connected with the diaphragm (72) which itself extends from the inner wall of the chamber (56).

If—as was explained in connection with the course of functioning of the control arrangement (10) of FIGS. 1 to 4—the chamber (56) is charged in the required amount with underpressure, the valve (20), i.e. the valve head (23), can be spontaneously lifted off the opening (48) leading to the underpressure connector (44) if the underpressure in the chamber (56) overcomes the force exerted by the magnet (74) on the metal plate (76). At this moment the valve piston moves in the direction of the arrow (80) to open the valve (20), so that a position is attained which corresponds to that in FIG. 3 or FIG. 4.

The retaining force can be changed by the size of the metal plate (76), by means of which it is possible in turn to preset the time of the abrupt opening of the valve (20) as a function of the underpressure in the chamber (56).

Closing of the valve (20) basically also occurs abruptly, namely when the valve (14) is closed and atmospheric pressure flows into the chamber (56) via the opening (68) as well as the line (66) and the throttle (64), which is interchangeable in the exemplary embodiment of FIG. 5 and provides the time control. Because of this a pressure increase takes place, so that the valve piston (78) is moved to a certain extent into its closed position based on the spring force exerted by the diaphragm (77) and then, when the force exerted by the magnet (74) on the plate (76) is sufficient for pulling the plate (76) against the magnet (74), it causes switching of the valve (20) which can be called abrupt.

As has been previously described, the spontaneous switching of the valve (20) from its upper end position into its lower closed end position does not take place from the start. Instead, first there is a slow movement of the piston (78) opposite the direction of the arrow (80). To prevent during this lift motion an undesirable overlap between the underpressure directed via the connector (42) to the shut-off valve and the atmospheric pressure flowing across the opening (68) and the annular chamber (26) coaxially surrounding the valve piston (78), the valve piston (78) has a cylindrical widening (82) on the side of the valve seat, which comes to rest against a circumferential seal (84) when the valve (20) is opened in order to block the opening (68) toward the atmosphere in respect to the chamber (21) which is located in the connection between the vacuum connector (44) and the shut-off valve connector (42). In this case the axial length of the cylindrical widening (82) in relation to the seal (84) has been selected to be such, that a seal is provided only at such a time at which the plate (76) is caught by the magnet (74) and is pulled against it.

As soon as the valve head (23) rests against the valve seat (48), there is a connection between the connector (68) and the chamber (21) via the annular conduit (26), since in this case the valve piston (78) extends at a distance from the seal (84).

I claim:

1. A method for controlling a vacuum operated shut-off valve in an underpressure waste water system, comprising:

applying static pressure caused by collected waste water to open a first valve;

applying negative pressure through the open first valve to a chamber adjacent to which chamber a valve piston of a second valve is in a first position where the second valve is closed;

increasing the negative pressure to a predetermined level so as to abruptly move the second valve piston to a second position where the second valve is open;

applying negative pressure to the vacuum operated shut-off valve via the second valve to cause aspiration of collected waste-water and therewith reduction of the pressure applied to the first valve so that the first valve is closed;

raising the pressure in the chamber as a function of time, and abruptly changing the position of the valve piston of the second valve from said second position to the first position at a preset pressure in the chamber so that the second valve abruptly ends the application of negative pressure to the vacuum operated shut-off valve.

2. A method in accordance with claim 1, wherein said step of raising the pressure in the chamber as a function of time includes the steps of applying ambient air or air under normal pressure and controlling the rate of applying the air.

3. A method in accordance with claim 1, wherein at preset pressures in the chamber (56) the second valve (20) is abruptly switched between the positions (CLOSED/OPEN and OPEN/CLOSED) so that negative pressure either reaches the shut-off valve or is blocked from reaching it.

4. A method in accordance with claim 1, wherein the second valve (20) in its position where it blocks the negative pressure from reaching the shut-off valve, is maintained by a force which in the presence of static pressure is only overcome if there is negative pressure sufficient for aspiring off waste water.

5. For use in a negative pressure waste water system, a control arrangement (10) for a negative-pressure operated shut-off valve said arrangement comprising:

a first valve (14) and a second valve (20), which first valve is opened by static pressure resulting from collected waste water, the second valve comprising a chamber (56), which is put under negative pressure by the first valve being open, a disposable valve piston (24), means for forcing the valve piston (24) to hold the second valve closed until the negative pressure in the chamber is sufficient to overcome said means for forcing so that the displaceable piston abruptly opens the second valve, whereby negative pressure is transmitted to the negative pressure operated shut-off valve for opening it, and said means for forcing causing the displaceable piston to abruptly close the second valve when the pressure in the chamber (56) rises to a preset level.

6. The control arrangement in accordance with claim 5, wherein the means for forcing includes a spring element (71) and at least one adjustable catch element (30, 32) acting on the second valve piston (24) so that opening of the second valve takes place only at a negative pressure which is sufficient for aspiring of waste water through the shut-off valve.

7. The control arrangement in accordance with claim 6, wherein the spring element (71) is disposed in the chamber (56), and the negative pressure for operating valve (20) is determined by the force of the spring element and the adjustable catch element.

8. The control arrangement in accordance with claim 5, wherein the valve piston (24) of the second valve (20) is displaceable relative to the chamber (56) and a diaphragm (72) extends from the valve piston (24) and the diaphragm is sealed against an inner wall of the chamber (56).

9. The control arrangement in accordance with claim 5, wherein the first and second valves (14, 20) are disposed in a single, housing (12), which includes a connector (18) for the static pressure, a connector (44) for connection to a negative pressure source as well as a connector (42) for connection to the shut-off valve, the valve piston (24) of the second valve (20) is displaceably guided in a first section (28) of the housing.

10. The control arrangement in accordance with claim 9, wherein the first housing section (28), receives the valve piston (24) in an axially displaceable manner, said means for forcing the valve piston include adjustable catch elements (30, 32) disposed so as to act radially on annular grooves of the valve piston for engagement when the valve is in closed or opened position.

11. The control arrangement in accordance with claim 5, wherein said means for forcing the valve piston (24) include a magnet (74) cooperating with a metal plate (76) to maintain the valve piston in a first position and in response to reaching a preset pressure in the chamber (56), the piston (24) abruptly moves from the first position into a second position so that in the first position the second valve (20) blocks the negative pressure connection with the negative pressure operated shut-off valve and in the second position opens the negative pressure connection with the negative pressure operated shut-off valve.

12. The control arrangement in accordance with claim 10, wherein the catch elements (30, 32) are spring-loaded balls and said annular grooves (34, 36) are spaced apart from each other in accordance with the valve piston corresponding to the valve open or valve closed position.

13. The control arrangement in accordance with claim 9, wherein a control conduit (50) leads from the connector (44) for the negative pressure via the first valve (14) to the chamber (56), the first valve (14) comprising a valve piston (22) with a valve head for blocking the connection to the chamber (56).

14. The control arrangement in accordance with claim 13, wherein the control conduit (50) is embodied as a bore arrangement extending within the housing (12).

15. The control arrangement in accordance with claim 13, wherein the valve head of the first valve (14) is displaceably disposed in a valve chamber (54), and a check valve (58) operates to block a connection between chamber (54) and chamber (56).

16. The control arrangement in accordance with claim 5, wherein the chamber (56) is connected via an orifice (64) with adjustable cross section and via an opening (68) to the atmosphere for ventilation, which opening (68) can be provided with a filter.

17. The control arrangement in accordance with claim 5 wherein the negative pressure operated shut-off valve is pressure-wise connected with the atmosphere via the second valve (20) in its closed position, which blocks the application of negative pressure of the negative pressure operated shut off valve, the second valve (20) includes a valve box (28), a valve chamber (21) and a valve piston (24), the valve box (28) comprises a bore (26) surrounding the valve piston (24), said bore providing a connection between the valve chamber (21) and the atmosphere and thus a path to disrupt the negative pressure in chamber (21) which in turn causes the negative pressure operated shut-off valve to close.

* * * * *